US007655101B2

(12) United States Patent
Putzgruber et al.

(10) Patent No.: US 7,655,101 B2
(45) Date of Patent: Feb. 2, 2010

(54) STEEL ALLOY FOR CUTTING TOOLS

(75) Inventors: Ernst Putzgruber, Bruck/Mur (AT); Devrim Caliskanoglu, Bruck/Mur (AT)

(73) Assignee: Boehler Edelstahl GmbH, Kapfenberg (AT)

( * ) Notice: Subject to any disclaimer, the term of this patent is extended or adjusted under 35 U.S.C. 154(b) by 47 days.

(21) Appl. No.: 11/924,795

(22) Filed: Oct. 26, 2007

(65) Prior Publication Data

US 2008/0101980 A1 May 1, 2008

(30) Foreign Application Priority Data

Oct. 27, 2006 (AT) ..... A 1814/2006

(51) Int. Cl.
*C22C 38/22* (2006.01)
*C22C 38/24* (2006.01)
*C21D 9/18* (2006.01)

(52) U.S. Cl. ..... 148/334; 148/663; 420/111

(58) Field of Classification Search ..... 148/334, 148/663; 420/111; 75/246
See application file for complete search history.

(56) References Cited

U.S. PATENT DOCUMENTS 5,435,827 A 7/1995 Wisell
7,229,507 B2 6/2007 Fukumoto et al.
2004/0187972 A1 9/2004 Ozaki
2005/0002820 A1 1/2005 Kugler et al.
2005/0155674 A1 * 7/2005 Johansson et al. ..... 148/334

FOREIGN PATENT DOCUMENTS

| | | | |
|---|---|---|---|
| AT | 412285 | | 12/2004 |
| CN | 1226609 | * | 8/1999 |
| EP | 1469094 | | 10/2004 |
| JP | 63-118054 | | 5/1988 |
| JP | 63-213641 | | 9/1988 |
| JP | 01-111846 | * | 4/1989 |
| JP | 02-285050 | * | 11/1990 |
| JP | 2001-200341 | | 7/2001 |
| RU | 2103410 | * | 1/1998 |

OTHER PUBLICATIONS

English Language Abstract of JP 63-118054.
English Language Abstract of JP 63-213641.
English Language Abstract of JP 2001-200341.

* cited by examiner

*Primary Examiner*—Deborah Yee
(74) *Attorney, Agent, or Firm*—Greenblum & Bernstein, P.L.C.

(57) ABSTRACT

A steel alloy for cutting tools, wherein the alloy comprises C, Si, Mn, Cr, Mo, W, V, Al, P, S and N within the concentration ranges recited in the claims. This abstract is neither intended to define the invention disclosed in this specification nor intended to limit the scope of the invention in any way.

20 Claims, 1 Drawing Sheet

STEEL ALLOY FOR CUTTING TOOLS

CROSS-REFERENCE TO RELATED APPLICATIONS

The present application claims priority under 35 U.S.C. § 119 of Austrian Patent Application No. A 1814/2006, filed Oct. 27, 2006, the entire disclosure whereof is expressly incorporated by reference herein.

BACKGROUND OF THE INVENTION

1. Field of the Invention

The present invention relates to a steel alloy for cutting tools.

2. Discussion of Background Information

In the machining of workpieces, the cutting edge area of the tool is subjected to multiple high loads. In order to withstand the cumulative load, the tool material must have a high hardness and toughness as well as a high abrasion resistance at the same time, which properties should be retained up to high temperatures, e.g., 550° C. and above. This is the only way to achieve high service life for the tool and an economic use of the same.

A load—to put it better, the profile of a load—of a cutting edge area of a tool during cutting or during machining, depends mainly on the type and properties of the tool material. High-speed steels, for instance, were thus developed with different chemical compositions, in particular adapted to the specific stresses in the machining of workpieces with different properties, and are part of the prior art.

However, high-speed steels predominantly have high contents of one or more expensive alloying elements, such as molybdenum, tungsten, vanadium, niobium and cobalt. Tungsten and/or molybdenum can be provided in contents of up to 20% by weight and higher, whereby vanadium can be alloyed in conventional PM (powder metallurgy) high-speed steels with contents of 1.2 to 15% by weight.

As previously indicated by means of a PM product variant, one problem is to be seen in the solidification structure as a function of the chemical composition of the alloy. For example, it is proposed in EP 1 469 094 A1 to subject a high-speed steel ingot to a long-time solution annealing treatment, whereby a cooling from 1200° C. to 1300° C. to a temperature of below 900° C. is to be carried out at a rate of more than 3° C./min. Small carbide sizes with uniform carbide distribution in the tool material and consequently a high toughness of the same can be achieved in this manner.

AT 412 285 B discloses a steel for cutting tools with low cost for alloying elements. This steel, which can be used advantageously in particular for circular saws, uses a specific aluminum to nitrogen ratio in order to keep the removal wear on the tool low. However, sawteeth usually work at lower temperatures during machining, so that no marked tempering temperature resistance of the material is usually required.

It would be advantageous to have available a steel for cutting tools which exhibits a fine solidification structure and a good hot-working capability, has a high hardness generation and tempering stability and shows great economic efficiency and/or a favorable price/performance ratio.

SUMMARY OF THE INVENTION

The present invention provides a steel alloy for cutting tools. The alloy comprises (e.g., consists essentially of), in percent by weight based on the total weight of the alloy:

C=from about 0.76 to about 0.89

Si=from about 0.41 to about 0.59
Mn=from about 0.15 to about 0.39
Cr=from about 3.60 to about 4.60
Mo=from about 2.00 to about 3.15
W=from about 1.50 to about 2.70
V=from about 0.80 to about 1.49
Al=from about 0.60 to about 1.40
P=up to 0.03
S=from about 0.001 to about 0.30
N=from about 0.01 to about 0.10
with the remainder being constituted by Fe and impurity elements.

In one aspect, the alloy may comprise one or more (e.g., all) of the following elements in the following weight percentages:

C=from about 0.80 to about 0.85
Si=from about 0.45 to about 0.55
Mn=from about 0.20 to about 0.30
Cr=from about 4.00 to about 4.39
Mo=from about 2.40 to about 2.80
W=from about 1.90 to about 2.30
V=from about 1.00 to about 1.20
Al=from about 0.80 to about 1.20.

In another aspect of the alloy, the concentration of (Mo+W/2) may be from about 3.3% to about 4.0% by weight, for example, from about 3.4% to about 3.9% by weight (or from about 3.5% to about 3.9% by weight).

The present invention also provides a cutting tool which comprises the alloy of the present invention as set forth above (including the various aspects thereof).

In one aspect, the cutting tool may have a material hardness of greater than about 63 HRC, e.g., at least about 65 HRC.

In another aspect, the cutting tool may comprise a microstructure which is formed of tempered martensite.

In yet another aspect, the cutting tool may comprise a knife.

The present invention also provides a method of making a cutting tool and the cutting tool made thereby. The method comprises heat-treating, tempering and forming the alloy of the present invention as set forth above (including the various aspects thereof).

In one aspect of the method, the alloy may be heat-treated at a temperature of from about 1100° C. to about 1250° C.

In another aspect, the alloy may be tempered at a temperature of from about 500° C. to about 600° C.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
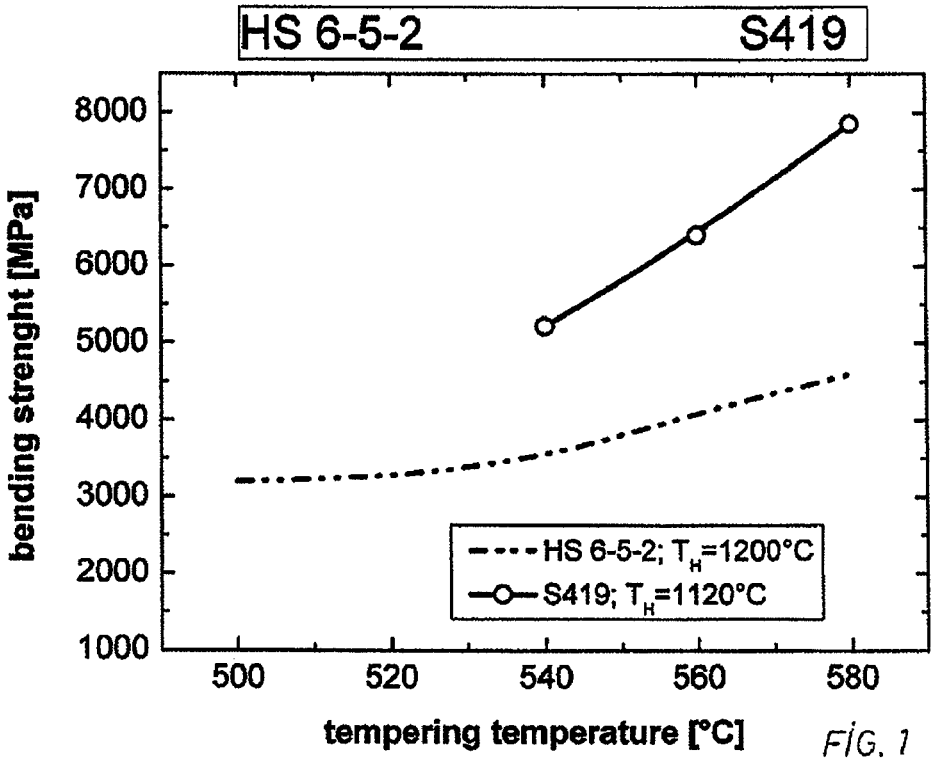
FIG. 1 shows the toughness (bending strength) values measured with two impact bending strength samples after hardening and tempering.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

According to the present invention, the overall solution to problems in terms of solidification technology, deformation technology, hardening technology and economic efficiency may be attained with a steel alloy for cutting tools as set forth above.

The composition of the steel alloy according to the invention has advantages in terms of metallurgical technology, which are present synergistically with the specified concentration ranges of the alloying elements.

The carbon content or the carbon activity is in interaction with the monocarbide-forming element vanadium, with the strong carbide-formers molybdenum and tungsten and with chromium, whereby the alloying element aluminum, which limits the area of the cubic face-centered atomic structure of the alloy, also, as it has turned out, favorably influences the solidification structure and thus a formability of the material and shows a great impact on the hardening behavior and on the tempering stability of the tool.

Within the range of from about 0.60% to about 1.40% by weight of aluminum in the alloy according to the invention, a coarse carbide precipitation may be reduced with a ledeburitic residual solidification of the melt, and a fine-grained carbide formation may be achieved in the solidification structure.

In comparison to a high-speed steel ingot of the alloy HS 6-5-2 or DIN material no. 1.3343, an ingot with the same dimensions but from an alloy in accordance with the present invention showed a better formability with higher reductions.

After a soft annealing treatment, a largely uniform distribution of the carbides with small grain size was determined microscopically in the rolling material according to the present invention.

Material tests after a heat treatment with a hardening from a temperature of from 1190° to 1230° C. with subsequent cooling in oil and a tempering in a temperature range of from 500° to 580° C. produced the following results:

Starting at a content of about 0.76% by weight, carbon in combination with a concentration of greater than about 0.8% by weight of vanadium and greater than about 1.5% by weight of tungsten and at least about 2.0% by weight of molybdenum in the presence of at least about 3.60% by weight of chromium results in a desired hardness generation of the workpiece, whereby aluminum with at least about 0.60% by weight promotes the core hardening, produces high material toughness and in particular shifts the tempering stability to higher temperatures and longer times. Contents of carbon of higher than about 0.89% by weight, of vanadium of higher than about 1.49% by weight, of tungsten of higher than about 2.70% by weight and of chromium of higher than about 4.60% by weight result in coarse carbide precipitations from the melt and in disadvantageously coarse carbide grains in the material even with contents of about 1.40% by weight of aluminum, whereby aluminum concentrations higher than about 1.40% by weight can also cause a general coarse-grain formation. It was also found that with the aluminum contents the nitrogen in concentrations of from about 0.01% to about 0.1% by weight acts to refine the grains and to improve the properties for the tool. However, higher nitrogen contents mostly form coarse nitrides which are distributed inhomogeneously in the material in a disadvantageous manner.

Silicon within the range of from about 0.41% to about 0.59% by weight in the steel has an advantageous effect on the inclusion content and the hardenability of the material, whereby manganese acts in a supporting manner. A binding of sulfur in the form of manganese sulfide can be ensured from a part of the manganese content in the alloy which has values of from about 0.15 % to about 0.39% by weight.

Further improved properties of the steel alloy may be achieved if one or more of the following elements are present therein in the following concentration ranges:

C=from about 0.80 to about 0.85
Si=from about 0.45 to about 0.55
Mn=from about 0.20 to about 0.30
Cr=from about 4.00 to about 4.39
Mo=from about 2.40 to about 2.80
W=from about 1.90 to about 2.30
V=from about 1.00 to about 1.20
Al=from about 0.80 to about 1.20

It was found to be favorable for the material toughness and advantageous for the hardness generation of the material, if molybdenum and tungsten are contained in the steel alloy in a balanced ratio with minimum contents of about 2.00% by weight and about 1.50% by weight, respectively. In a particularly preferred embodiment the alloy according to the invention has a value of the concentration of molybdenum plus half of the concentration of tungsten of from about 3.3% to about 4.0% by weight; in particular with a value of from about 3.4% to about 3.9% by weight a property profile of the heat-treated tool that is favorable to an above-average extent can be achieved.

A cutting tool comprising a steel alloy with a chemical composition according to the present invention which preferably is formed and heat-treated at least about 4.1-fold may have a material hardness of greater than about 63 HRC at least in the operating range, may have a microstructure formed from tempered martensite, and may have good use properties and high toughness in cutting operation. The economic advantages of the steel alloy result from an approximately 50% reduction of the alloying costs for molybdenum, tungsten and vanadium.

As an embodiment of the invention showing tools with different compositions of the steel compared to those of the material HS 6-5-2 or DIN material no. 1.3343, the following is described in more detail below:

Rotary knives, which had been heat treated through hardening and tempering three times, were tested in the cutting test operation on a workpiece of the material St33 or of DIN material no. 1.0035 in intermittent cutting.

The chemical composition and the hardness of the rotary knives are given in the following Table 1 and Table 2.

TABLE 1

| Material | C | Si | Mn | Cr | Mo | W | V | Al | N | S | Mo + W/2 |
|---|---|---|---|---|---|---|---|---|---|---|---|
| 1. HS 6-5-2 | 0.87 | 0.26 | 0.25 | 3.96 | 4.81 | 6.68 | 1.83 | — | — | 0.015 | 8.15 |
| 2. HS 6-5-2 | 0.90 | 0.21 | 0.34 | 4.19 | 5.20 | 6.56 | 1.90 | — | — | 0.009 | 8.48 |

TABLE 1-continued

| Material | C | Si | Mn | Cr | Mo | W | V | Al | N | S | Mo + W/2 |
|---|---|---|---|---|---|---|---|---|---|---|---|
| Test alloy A | 0.80 | 0.48 | 0.38 | 4.51 | 2.23 | 2.59 | 0.92 | 0.71 | 0.009 | 0.02 | 3.53 |
| Test alloy S | 0.83 | 0.50 | 0.26 | 4.20 | 2.61 | 2.11 | 1.11 | 1.02 | 0.03 | 0.064 | 3.67 |
| Test alloy C | 0.88 | 0.47 | 0.21 | 3.74 | 3.06 | 1.75 | 1.38 | 1.32 | 0.008 | 0.005 | 3.90 |

TABLE 2

| Material | Hardness in HRC |
|---|---|
| 1. HS 6-5-2 | 64 |
| 2. HS 6-5-2 | 65 |
| Test alloy A | 64 |
| Test alloy S | 65 |
| Test alloy C | 66 |

Until the rotary knives were eliminated in the test operation because of wear, assessments were made of the blade area, the results of which are given comparatively in Table 3, the values of the alloy 1 HS 6-5-2 being designated 100% in each case.

TABLE 3

| Material | Operating time % | Edge-holding capability % | Resistance to crater wear % |
|---|---|---|---|
| 1. HS 6-5-2 | 30% | 100 | 100 |
| 2. HS 6-5-2 | 30% | 105 | 110 |
| Test alloy A | 30% | 92 | 98 |
| Test alloy S | 30% | 96 | 100 |
| Test alloy C | 30% | 94 | 100 |
| 1. HS 6-5-2 | 60% | 100 | 100 |
| 2. HS 6-5-2 | 60% | Breakage of tool blade | |
| Test alloy A | 60% | 93 | 98 |
| Test alloy S | 60% | 97 | 100 |
| Test alloy C | 60% | 95 | 99 |
| 1. HS 6-5-2 | 90% | 100 | 100 |
| 2. HS 6-5-2 | 90% | — | — |
| Test alloy A | 90% | 92 | 89 |
| Test alloy S | 90% | 95 | 92 |
| Test alloy C | 90% | 92 | 94 |

Tests regarding toughness and hardness depending on the tempering temperature were carried out on samples of test alloy S with the designation S419 in comparison to 2. HS 6-5-2.

FIG. 1 shows the toughness (bending strength) values measured with impact bending strength samples according to STAHL-EISEN test specifications (SEP) after a hardening from a hardening temperature $T_H$ of 1200° C. or 1120° C. and a tempering in the temperature range between 500° C. and 580° C. or 540° C. and 580° C. The significantly higher toughness of the material according to the present invention is also due to the lower carbide content of 4% by volume (HS 6-5-2 approx. 10% by volume).

Figure 2:
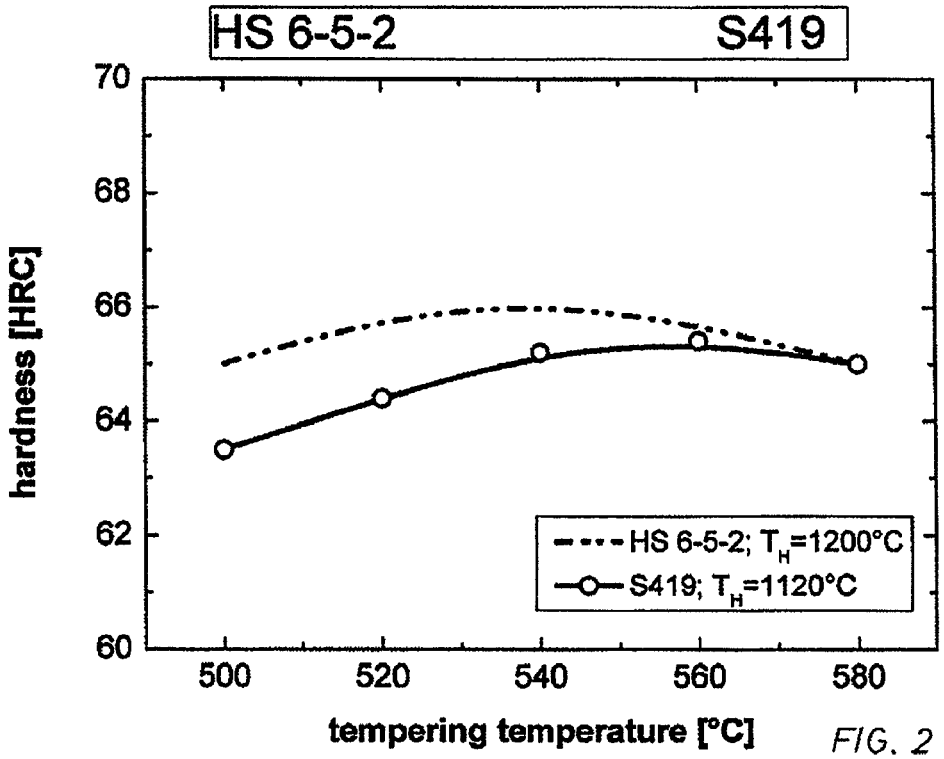
FIG. 2 shows the material hardness values of the two samples as a function of the tempering temperature.

FIG. 2 shows the material hardness values with a hardening of 1200° C. or of 1120° C. as a function of the tempering temperature. With increasing tempering temperatures of greater than about 500° C., the hardness values of the test alloy come up to close to those of the 2. HS 6-5-2 and at 580° C. reach the same level of 65 HRC.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A steel alloy for cuffing tools, wherein the alloy consists of, in percent by weight based on a total weight of the alloy:

C=from about 0.76 to about 0.89
Si=from about 0.41 to about 0.59
Mn=from about 0.15 to about 0.39
Cr=from about 3.60 to 4.60
Mo=from about 2.00 to 3.15
W=from about 1.50 to about 2.70
V=from about 0.80 to about 1.49
Al=from about 0.60 to about 1.40
P=up to 0.03
S=from about 0.001 to about 0.30
N=from about 0.01 to about 0.10,
remainder Fe and impurity elements.

2. The alloy of claim 1, wherein the alloy comprises one or more of the following elements in percent by weight:

C=from about 0.80 to about 0.85
Si=from about 0.45 to about 0.55
Mn=from about 0.20 to about 0.30
Cr=from about 4.00 to 4.39
Mo=from about 2.40 to 2.80
W=from about 1.90 to about 2.30
V=from about 1.00 to about 1.20
Al=from about 0.80 to about 1.20.

3. The alloy of claim 1, wherein the alloy comprises, in percent by weight:

C=from about 0.80 to about 0.85
Si=from about 0.45 to about 0.55
Mn=from about 0.20 to about 0.30
Cr=from about 4.00 to 4.39
Mo=from about 2.40 to 2.80
W=from about 1.90 to about 2.30
V=from about 1.00 to about 1.20
Al=from about 0.80 to about 1.20.

4. The alloy of claim 1, wherein a concentration of(Mo+W/2) is from about 3.3% to about 4.0% by weight.

5. The alloy of claim 1, wherein a concentration of (Mo+W/2) is from about 3.4% to about 3.9% by weight.

6. The alloy of claim 2, wherein a concentration of(Mo+W/2) is from about 3.3% to about 4.0% by weight.

7. The alloy of claim 2, wherein a concentration of(Mo+W/2) is from about 3.4% to about 3.9% by weight.

8. The alloy of claim 3, wherein a concentration of(Mo+W/2) is from about 3.3% to about 4.0% by weight.

9. The alloy of claim 3, wherein a concentration of(Mo+W/2) is from about 3.4% to about 3.9% by weight.

10. A cuffing tool, wherein the cutting tool comprises a formed and heat-treated alloy of claim 1.

11. The cutting tool of claim 10, wherein the cuffing tool has a material hardness of greater than about 63 HRC.

12. The cutting tool of claim 10, wherein the cutting tool has a material hardness of at least about 65 HRC.

13. The cutting tool of claim 10, wherein the cutting tool comprises a microstructure of tempered martensite.

14. The cutting tool of claim 11, wherein the cutting tool comprises a microstructure of tempered martensite.

15. The cutting tool of claim 10, wherein the cuffing tool comprises a knife.

16. A method of making a cuffing tool, wherein the method comprises heat-treating, tempering and forming the alloy of claim 1.

17. The method of claim 16, wherein the alloy is heat-treated at a temperature of from about 1100° C. to about 1250° C.

18. The method of claim 16, wherein the alloy is tempered at a temperature of from about 500° C. to about 600° C.

19. The method of claim 17, wherein the alloy is tempered at a temperature of from about 500° C. to about 600° C.

20. A cutting tool made by the method of claim 16.

* * * * *